US005725695A

United States Patent [19]

Ward et al.

[11] Patent Number: 5,725,695

[45] Date of Patent: Mar. 10, 1998

[54] METHOD OF MAKING ALUMINUM ALLOY FOIL AND PRODUCT THEREFROM

[75] Inventors: Bennie R. Ward, Richmond; Richard E. Hughes, Toano; James P. Martin, Powhatan, all of Va.

[73] Assignee: Reynolds Metals Company, Richmond, Va.

[21] Appl. No.: 624,728

[22] Filed: Mar. 26, 1996

[51] Int. Cl.[6] ..... C22C 21/00

[52] U.S. Cl. ..... 148/552; 148/697; 148/695; 148/696; 148/439; 420/528

[58] Field of Search ..... 148/697, 695, 148/696, 439; 420/528

[56] References Cited

U.S. PATENT DOCUMENTS

| | | | |
|---|---|---|---|
| 2,109,117 | 2/1938 | Matuenaga | 75/142 |
| 3,676,111 | 7/1972 | Wieser et al. | 75/142 |
| 4,000,009 | 12/1976 | Chatfield | 148/2 |
| 4,033,794 | 7/1977 | Stowell et al. | 148/32 |
| 4,164,434 | 8/1979 | Fister, Jr. et al. | 148/2 |
| 4,483,719 | 11/1984 | Furrer et al. | 148/2 |
| 4,586,964 | 5/1986 | Finnegan et al. | 148/11.5 |
| 4,735,867 | 4/1988 | Finnegan et al. | 428/654 |
| 5,041,343 | 8/1991 | Fortin et al. | 428/654 |

FOREIGN PATENT DOCUMENTS

Wo 95/27805 11/1995 WIPO ..... C22F 1/04

OTHER PUBLICATIONS

A.L. Dons, "Variations In The Composition Of AlMnFeSi—Particles in Aluminum", Scan J. Metallurgy 13 (1984).

Chemistry of an Aluminum Alloy Designated as AA8111 in the As–Cast Coil Condition, Print Key Output, 1 page, Jun. 7, 1994.

*Primary Examiner*—David A. Simmons
*Assistant Examiner*—M. Alexandra Elve
*Attorney, Agent, or Firm*—Alan M. Biddison

[57] ABSTRACT

A method of making an aluminum foil product from an aluminum-silicon-iron aluminum alloy comprises casting the alloy into a slab, preferably by twin roll casting, cold rolling the alloy to an intermediate gauge and reroll annealing the intermediate gauge material. The reroll annealed material is then cold rolled to a final foil gauge followed by a final recrystallizing annealing. The aluminum alloy has a controlled amount of silicon and iron such that the silicon is equal to or greater than the iron amount and the reroll anneal temperature is 800° F. (427° C.) or less. The combination of the controlled amounts of silicon and iron and the lower reroll anneal temperature results in an improved foil product in terms of finer grain size and higher elongation which is also less costly to produce.

14 Claims, 1 Drawing Sheet

METHOD OF MAKING ALUMINUM ALLOY FOIL AND PRODUCT THEREFROM

FIELD OF THE INVENTION

The present invention is directed to a method of making an aluminum alloy foil and a foil product therefrom and, in particular, a method utilizing an aluminum alloy chemistry which permits the use of lower reroll anneal temperatures and lower casting thicknesses while improving foil properties.

BACKGROUND ART

In the prior art, one aluminum alloy used for foil production is AA8111. The registered compositional limits for this alloy are, in weight percent, 0.30–1.1 Si, 0.40–1.0 Fe, 0.10 max Cu, 0.10 max Mn, 0.05 max Mg, 0.20 max Cr, 0.10 max Zn, 0.08 max Ti, 0.05 max for each unlisted elements, 0.15 max for the total of unlisted elements with the balance being Al. In a preferred chemistry, the iron content is maintained greater than the silicon content.

In one practice for making foil, the aluminum alloy is twin roll continuously cast to a cast gauge of about 0.400 inches (10 mm). The cast slab is then cold rolled to an intermediate gauge, usually about 0.045 inches (1.14 mm), reroll annealed at 850° F. (454° C.), and cold rolled to a final foil gauge of between about 0.0005 inches (13 μm) and about 0.0020 inches (50 μm). The foil is then final annealed at 550° F. (288° C.).

A principal goal in making aluminum foil product is producing a fine recrystallized grain size. By obtaining a small grain size in the foil product, the foils are strengthened by Hall-Petch grain strengthening. In addition, ductility is improved since the number of grains per foil cross-section increases.

As in any foil manufacturing operation, it is desired to increase the production rate as well as reduce the operating costs. One method to achieve these goals includes increasing the caster output by casting to thinner gauge slabs which in turn also reduces the amount of cold rolling reduction required to achieve final foil gauge.

One of the problems associated with casting AA8111 alloys at thinner casting gauges and presently used reroll anneal temperatures is the inability to achieve a fine grain size in the final foil product. It is believed that the constituent particles present during the reroll anneal are not of the required size, density or interparticle spacing to provide the necessary nucleation sites for new grain growth. While the lack of a fine grain size in AA8111 cast at thinner gauges and reroll anneal at 850° F. (454° C.) could be overcome by merely increasing the reroll anneal temperature, such an option goes directly against the goal of making foil products with lower operating costs.

As such, a need has developed to provide a method of making an aluminum foil product which permits the use of increased caster outputs, i.e., thinner gauge cast slabs, at lower operating costs.

The present invention overcomes these problems through the use of an AA8111 type alloy having a silicon content greater than or equal to iron. This aluminum alloy is capable of being cast at thinner gauges and, quite surprisingly, reroll annealed at lower temperatures than that used in the prior art processing to produce an improved final foil product.

SUMMARY OF THE INVENTION

Accordingly, it is a first object of the present invention to provide a method of making an improved aluminum alloy foil product.

Another object of the present invention includes making an aluminum alloy foil product using thinner gauge slabs and lower reroll anneal temperatures than presently used in the prior art.

A further object of the present invention is to provide an aluminum alloy foil product which exhibits improved properties over prior art foils in terms of finer grain size and better elongation.

Other objects and advantages of the present invention will become apparent as a description thereof proceeds.

In satisfaction of the foregoing objects and advantages, the present invention provides an improvement in the known method of making aluminum alloy foils and products by twin roll casting an AA8111 alloy into a cast slab of specified thickness, cold rolling the cast slab to an intermediate gauge strip, reroll annealing the intermediate gauge strip at 850° F. (454° C.) for a period of time, final cold rolling the intermediate gauge strip to a foil and final recrystallizing annealing the foil. According to the invention, the amounts of silicon and iron in the aluminum alloy are controlled such that the silicon amount is equal to or greater than the iron amount and the reroll annealing temperature is limited to a maximum of 825° F. (441° C.).

More preferably, the iron and silicon amounts range between 0.55 and 0.75 wt % and the silicon amount is controlled to be about 0.05 wt % greater than the iron amount.

The inventive processing makes an aluminum alloy foil product which has a finer grain size and higher elongation than AA8111 foil products which are processed conventionally. The inventive foil product having a silicon amount greater than or equal to the iron amount results in a constituent size in the foil which is larger than the constituent size found in prior art AA8111 foil products. This larger constituent size contributes to the finer grain size in the final gauge foil.

More preferably, the aluminum alloy is twin roll cast to a slab thickness of about 0.240 inches (6 mm) or less to increase the foil production. Even with this increased foil production, the final gauge foil product exhibits acceptable foil properties.

BRIEF DESCRIPTION OF DRAWINGS

Reference is now made to the sole drawing of the invention wherein a schematic flow diagram is shown exemplifying one embodiment of the method of the invention.

DESCRIPTION OF THE PREFERRED EMBODIMENTS

Figure 1:
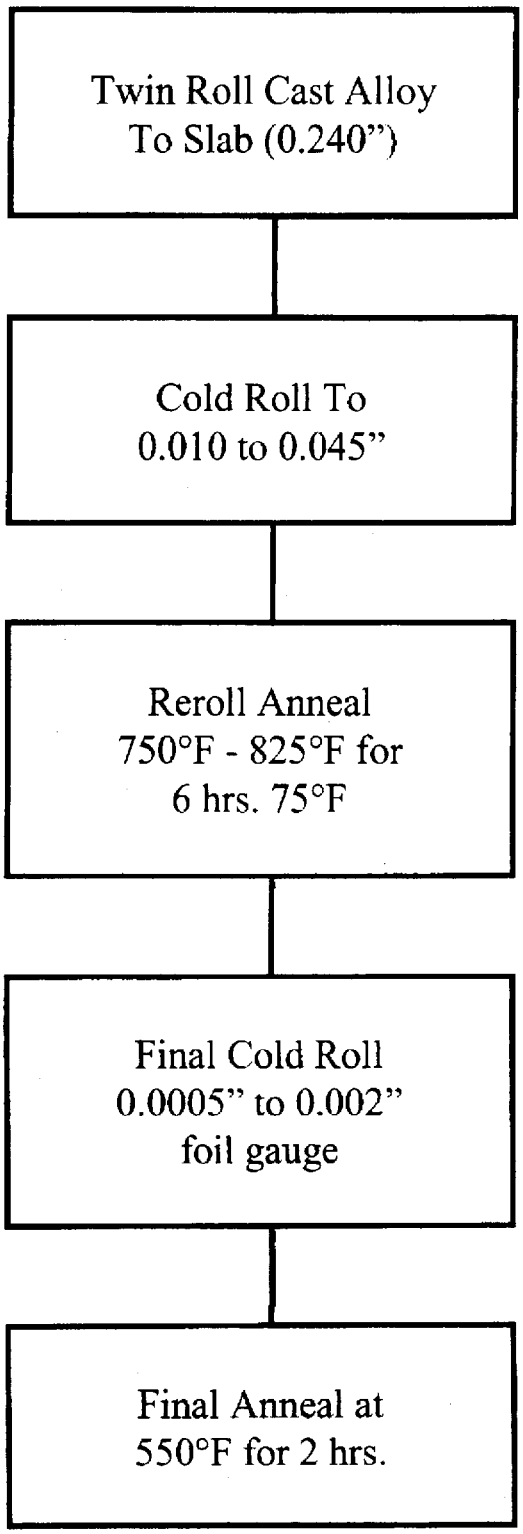

The present invention offers a two-fold advantage over the existing method of making aluminum alloy foil from an AA8111 alloy. First, as will be more fully explained below, AA8111 alloys are not economically conducive to twin roll casting at gauges that are lower than presently used, i.e., 0.400 inches (10 mm). When these alloys are cast at thinner gauges, the final gauge foil properties are compromised as a result of the alloy chemistry. Improving the final foil gauge properties when casting is done at thinner gauges results in an unattractive processing since reroll anneals must be conducted at significantly higher temperatures.

Quite surprisingly, the inventive processing not only permits the casting of thinner gauge materials but also provides an economic benefit since acceptable foil properties are attainable at reroll anneal temperatures lower than those presently used in conventional processing.

As referenced above, AA8111 alloys when processed conventionally from a cast slab, are not conducive to cast thicknesses less than those conventionally used, i.e., 0.400 inches (10 mm). The following experiment demonstrates that when an AA8111 alloy with conventional chemistry is cast at a thickness of 0.240 inches (6 mm), the final gauge foil properties are less than desirable. In this experiment, material as set forth in Table 1 was twin roll cast to both 0.240 inches (6 mm) and 0.400 inches (10 mm) thicknesses. The samples were then directly cold rolled to 0.045 inches (1.14 mm). The cold rolled material was divided into six sections and given three different reroll anneals from 850° F. to 950° F. (454° to 510° C.) for six hours with a 75° F. (42° C.) per hour heat-up and cool-down. The samples were then rerolled from 0.045 inches (1.14 mm) down to a final, relatively thin foil gauge and then given a final anneal at 550° F. (288° C.) for two hours with a 75° F. (42° C.) per hour heat-up and cool-down.

Evaluating the six microstructures of the foil material revealed that the grain size for the 0.400 inch (10 mm) material was smaller than the 0.240 inch (6 mm) material, regardless of the reroll anneal temperature. More specifically, the ASTM grain size of the 0.240 inch (6 mm) material ranged from 5 to 5.5. The ASTM grain size of the 0.400 inch (10 mm) material ranged between 6 and 6.5.

These results indicate that the AA8111 material when cast at a thinner gauge and processed according to conventional reroll annealing, cold rolling and final annealing practices, did not attain a grain size which is preferred for a foil material. It is believed that the 0.240 inch (6 mm) material solidifies at a faster rate than the 0.400 inch (10 mm) material for the same volume of caster output. With a more rapid solidification rate, more of the iron/silicon constituents remain in solid solution and are not present to key dislocations so that a fine grain size foil is not realized at the final foil gauge.

Referring now to the sole figure, an exemplary processing sequence is illustrated for the inventive method. An aluminum alloy is melted and conventionally twin roll cast to a thickness of 0.240 inches (6 mm). Of course, any known continuous casting methods can be used with the inventive method. The alloy chemistry is discussed in more detail below. The cast slab is then cold rolled to an intermediate gauge of 0.010 inches to 0.045 inches (0.25 mm to 1.14 mm) followed by reroll annealing between 750° F. and 825° F. (399° C. and 441° C.) for about 6 hrs., with a 75° F. (42° C.) per hour heat-up and cool-down. The reroll annealed strip is then final cold rolled to foil gauge and final recrystallized annealed at 550° F. (288° C.) for about two hours. This process provides an improved foil product having a thickness of between about 0.0005 inches (13 μm) and about 0.0020 inches (50 μm). In one embodiment the thickness is between about 0.0006 inches (15 μm) and about 0.0007 inches (18 μm). It should be understood that the variables used for this exemplary processing are preferred and other times, temperatures, etc. as would be known to one skilled in the art, could also be used.

The following experiments demonstrate the surprising results associated with the inventive method wherein an aluminum alloy falling within the broad AA8111 limits has its silicon and iron controlled so that the silicon is equal to or greater than the iron and the reroll anneal temperature is held to a maximum of 825° F. (441° C.) to produce an aluminum alloy foil having improved foil properties.

To demonstrate the unexpected improvements associated with the inventive method, experiments were conducted comparing an aluminum alloy chemistry representative of conventional AA8111 with a similar alloy chemistry, except that the silicon amount exceeded the iron amount. Slabs with these two chemistries were then processed to simulate production foil making at different reroll anneal temperatures and different intermediate cold rolling gauges. The experiments below refer to alloying elements in weight percent unless otherwise indicated and are intended to show preferred embodiments of the invention but are not considered to be limiting thereto.

Experiment 1

Chemistry:

Table 2 details the silicon and iron weight percentages for two alloys identified as Alloy A and Alloy B. Alloy A is representative of the prior art, with Alloy B representing an alloy similar to conventional AA8111 but having the silicon content greater than the iron content.

Processing Sequence

Alloys A and B were twin roll cast using a production twin roll caster into an as-cast slab of 0.400 inches (10 mm) thickness. The as-cast slab was cold rolled to three intermediate gauges, 0.010 inches (0.254 mm), 0.020 inches (0.51 mm) and 0.045 inches (1.14 mm). These cold rolled samples were then reroll annealed at temperatures of 800° F. (427° C.) for 6 hours with a 75° F. (42° C.) per hour heat-up and cool-down and 850° F. (454° C.) for 5 hours with the same 75° F. (42° C.) per hour heat-up and cool-down. The intermediate gauge materials were then cold rolled to 0.002 inches (0.05 mm) and final annealed for 4 hours at 550° F. (288° C.) with the same 75° F. (42° C.) per hour heat-up and cool-down rate.

Mechanical Properties

After the foil material was final annealed, the mechanical properties of elongation, tensile strength and yield strength were determined for each reroll anneal temperature and each intermediate gauge. These properties are shown in Table 3.

Table 4 shows ASTM grain sizes for all samples using the reticule method on electrolytically etched foil surfaces.

As is evident from the comparative elongation properties, Alloy B exhibited greater elongation than Alloy A for all intermediate gauges and, particularly, at the 800° F. (427° C.) anneal. Likewise, Alloy B exhibited a finer grain size than Alloy A in each instance. The tensile and yield strength values were generally greater for Alloy B. It should also be noted that all samples were fully recrystallized regardless of reroll anneal gauge.

Experiment 2

To further investigate the effect of reroll anneal temperature on these alloy chemistries, an additional set of experiments was performed investigating lower reroll anneal temperatures.

Processing Sequence

The as-cast slabs of Alloys A and B at 0.400 inches (10 mm) were cold rolled to intermediate gauges of 0.045 inches (1.14 mm) and 0.020 inches (0.51 mm). These intermediate gauge materials were then reroll annealed at temperatures ranging from 750° F. (399° C.) to 850° F. (454° C.) in 25° F. (14° C.) increments for 6 hours, each with a 75° F. (42° C.) per hour heat-up and cool-down. The reroll anneal samples were then cold rolled to 0.002 inches (0.05 mm) and final annealed at 550° F. (288° C.) at the same conditions as Experiment 1.

Mechanical Properties

Table 5 compares the mechanical properties for Alloy A and Alloy B with respect to intermediate gauge and reroll anneal temperature.

Table 6 shows ASTM grain size comparisons as determined using the reticule method on electrolytically etched foil surfaces for Alloys A and B at the various reroll anneal temperatures and intermediate gauges.

Comparing the mechanical properties in Table 5, it is clear that Alloy B has a greater elongation and higher strength than Alloy A. Likewise, Alloy B has a finer recrystallized grain size than Alloy A. In addition, the grain size is finer when the intermediate gauge of 0.045 inches (1.14 mm) is utilized. The spread between tensile strength and yield strength is also improved for Alloy B which signifies both toughness and pliability.

Discussion

As set forth above, all of the samples appeared fully recrystallized regardless of the intermediate anneal temperatures or reroll anneal gauge. However, metallographic cross-section examinations of Alloys A and B revealed that Alloy B had a uniform recrystallized grain through its cross-section whereas Alloy A had a non-uniform grain structure with coarse recrystallized grains near the surface.

The constituent size and distribution in the foil samples was investigated using scanning electron microscopy (SEM). This investigation consistently showed that the constituent size and distribution between Alloy A and Alloy B was different. Typically, the constituent size in the Alloy A foil was predominantly slightly less than 1 micron while the constituent size in the Alloy B foil was approximately 1.5 microns.

STEM examination was also conducted on Alloys A and B with 800° F. (427° C.) and 850° F. (454° C.) reroll anneals at 0.045 inch (1.14 mm) intermediate gauge. These foils were punched into three millimeter diameter disks and then electropolished to final thickness using a Tenupol twin jet electropolisher set between 10 and 13 volts. The electrolyte, a 25% nitric acid/75% methanol mixture, was kept between −20° C. and −35° C. during electropolishing. To observe the phase size and distribution and for microanalysis of phases, a Phillips 420 T-STEM equipped with an EDAX-X-ray detector in a double tilt low background goniometer was employed. Alloys A and B were prepared for morphology (appearance) initially on selected phases analyzed for the presence of silicon using energy dispersive spectroscopy. Qualitative comparison verified that, in general, alloy B had slightly larger constituents and the constituents were generally silicon rich. It is believed that the higher silicon content of Alloy B has an effect of increasing the median size of the constituents and increasing the number of silicon rich constituents which in turn result in more effective nuclei for the formation of a greater number of fine grains.

Based on the experimentation done above, it is clear that Alloy B has a finer recrystallized grain size than Alloy A due to the effective higher silicon, this higher silicon contributing to the formation of larger and more effective nuclei for the formation of fine recrystallized grains. Moreover, a fine grain recrystallized foil was produced from Alloy B when given an intermediate anneal less than 850° F. (454° C.). Thus, a foil product can be manufactured using a more economical intermediate reroll anneal than that used in conventional processing. In addition, a stronger more ductile foil is also made using lower reroll anneal temperatures where the silicon content is greater than the iron content.

Based on the experiments above wherein it was shown that casting thinner gauge AA8111 alloys results in a coarser grain size final foil product, it is believed that an acceptable foil product can be made using the chemistry wherein Si is equal to or greater than iron since the existence of higher levels of silicon in this alloy chemistry will provide more nucleation sites for grain growth and a finer final grain size. The conventional AA8111 alloy may not be able to be twin roll cast at a lower gauge, e.g., 0.240 inches (6 mm) and given a standard reroll anneal of 850° C. (454° C.) to achieve an acceptable foil product. With the inventive processing, a fine grained strong and ductile foil product can be made using a chemistry wherein the silicon is equal to or greater than the iron and a reroll anneal temperature which is economically attractive, i.e. 825° F. (441° C.) or less.

Table 7 illustrates a preferred alloy chemistry for use in the inventive method. More preferably, the silicon is maintained to be about 0.05% by weight greater than the iron. The silicon can range between about 0.65 and 0.70% with the iron ranging between about 0.60 and 0.65% by weight.

The inventive processing produces a foil product which has a finer grain size than AA8111 alloys as well as higher elongation and strength. The constituents in the foil are believed to be higher in silicon amount than AA8111 foil product constituents and are larger in size. This increased constituent size as a result of the inventive processing contributes to the overall improved foil properties associated with the foil product.

As such, an invention has been disclosed in terms of preferred embodiments thereof which fulfills each and every one of the objects of the present invention as set forth hereinabove and provides a new improved method for making an aluminum alloy foil product and a product therefrom.

Of course, various changes, modifications and alterations from the teachings of the present invention may be contemplated by those skilled in the art without departing from the intended spirit and scope thereof. Accordingly, it is intended that the present invention only be limited by the terms of the appended claims.

TABLE 1

CHEMICAL COMPOSITIONS (AA8111) (In Weight %)

| (Gauge) | Si | Fe | Cu | Mn | Mg | Cr | Ni | Zn | Ti |
|---|---|---|---|---|---|---|---|---|---|
| (6 mm) | .48 | .59 | <.01 | <.01 | .01 | <.01 | <.01 | .02 | <.01 |
| (10 mm) | .51 | .64 | <.01 | .01 | <.01 | <.01 | <.01 | .02 | <.01 |

TABLE 2

CHEMICAL COMPOSITIONS* (In Weight %)

| | ID | Designation | % Si | % Fe |
|---|---|---|---|---|
| Alloy | A | Fe > Si | .51 | .61 |
| Alloy | B | Si > Fe | .64 | .60 |

*Remaining elements fall with AA8111 limits

TABLE 3

| | MECHANICAL PROPERTIES | | | | | | | | | | |
|---|---|---|---|---|---|---|---|---|---|---|---|
| | .045" | | | .020" | | | | .010" | | | |
| ID | Gauge | TS (KSI) | YS (KSI) | % EL | Gauge | TS (KSI) | YS (KSI) | % EL | Gauge | TS (KSI) | YS (KSI) | % EL |
| | | | | | 850° F. Reroll | | | | | | | |
| Alloy A | (.0020") | 11.35 | 4.82 | 9.4 | (.0018") | 11.05 | 4.5 | 10.7 | (.0016") | 11.13 | 4.5 | 11.5 |
| Alloy B | (.0019") | 12.47 | 5.46 | 10.83 | (.00175") | 12.2 | 5.0 | 12.31 | (.00175") | 11.38 | 4.58 | 12.1 |
| | | | | | 800° F. Reroll | | | | | | | |
| Alloy A | (.0020") | 12.11 | 5.44 | 9.62 | (.0017") | 11.45 | 4.68 | 10.51 | (.0016") | 11.20 | 4.8 | 9.11 |
| Alloy B | (.00185") | 13.13 | 5.68 | 11.37 | (.0017") | 12.24 | 4.94 | 12.77 | (.00185") | 11.92 | 5.16 | 12.3 |

TABLE 4

| | GRAIN SIZE (ASTM) | | |
|---|---|---|---|
| ID | .045" | .020" | .010" |
| | 850° F. | | |
| A | 6 | 6.5 | 6.5 |
| B | 6.5 | 7.0 | 6.5 |
| | 800° F. | | |
| A | 6.5 | 6.5 | 5/5.5 |
| B | 7 | 7 | 6 |

TABLE 5

| | MECHANICAL PROPERTIES | | | | | |
|---|---|---|---|---|---|---|
| | .020" | | | .045" | | |
| °F. | TS | YS | % EL | TS | YS | % EL |
| | ALLOY A (.51 Si; .61 Fe) | | | | | |
| 750 | 10.76 | 4.72 | 9.53 | 11.43 | 5.31 | 9.38 |
| 775 | 11.25 | 4.69 | 10.60 | 11.84 | 5.23 | 10.85 |
| 800 | 11.72 | 4.52 | 14.16 | 11.86 | 5.17 | 10.03 |
| 825 | 11.15 | 4.58 | 10.62 | 11.80 | 5.11 | 11.19 |
| 850 | 11.33 | 4.55 | 12.00 | 11.80 | 5.11 | 11.57 |
| | ALLOY B (.64 Si; .60 Fe) | | | | | |
| 750 | 11.85 | 5.13 | 10.82 | 11.78 | 5.61 | 8.82 |
| 775 | 12.04 | 4.76 | 13.89 | 12.30 | 5.40 | 11.70 |
| 800 | 11.52 | 4.58 | 11.17 | 12.05 | 5.57 | 11.80 |
| 825 | 11.98 | 4.79 | 13.98 | 11.26 | 5.28 | 12.94 |
| 850 | 11.41 | 4.69 | 11.73 | 12.53 | 5.11 | 14.73 |

TABLE 6

| | GRAIN SIZE (ASTM) | | | |
|---|---|---|---|---|
| Reroll Anneal Gauge Alloy | .020" | | .045" | |
| Alloy | A | B | A | B |
| 750° F. | 6.0 | 7.0 | 6.5 | 8.0 |
| 775° F. | 6.5 | 7.0 | 7.0 | 7.0 |
| 800° F. | 6.0 | 7.0 | 7.0 | 7.5 |
| 825° F. | 6.0 | 6.5 | 7.0 | 7.5 |
| 850° F. | 6.0 | 7.0 | 6.5 | 7.5 |

TABLE 7

| ALLOY CHEMISTRY (In Weight %) | | | | | | | | |
|---|---|---|---|---|---|---|---|---|
| Si | Fe | Cu | Mn | Mg | Cr | Ni | Zn | Ti |
| .55–.75 | .55–.75 | .05 Max | .03 Max | .02 Max | .02 Max | — | .03 Max | .03 Max |

Note: Si equal to or greater than Fe, balance aluminum and unavoidable impurities

What is claimed is:

1. In a method of making an aluminum alloy foil product comprising the steps of casting an alloy consisting essentially of, in weight percent, 0.30–1.1 Si, 0.40–1.0 Fe, max 0.10 Cu, max 0.10 Mn, max 0.05 Mg, max 0.05 Cr, max 0.10 Zn, max 0.08 Ti, with the balance aluminum and unavoidable impurities into a cast slab of specified thickness, cold rolling the cast slab to an intermediate gauge strip, reroll annealing the intermediate gauge strip for a period of time, final cold rolling the intermediate gauge strip to a foil and final recrystallizing annealing the foil to form a foil product, the improvement comprising controlling the amounts of silicon and iron in the alloy so that the silicon amount is equal to or greater than the iron amount and reroll annealing the intermediate gauge sheet at a maximum temperature of 825° F. (441° C.) for said period of time, wherein the foil product having the silicon amount greater than or equal to the iron amount has a finer grain size when reroll annealed at 825° F. (441° C.) than an AA8111 foil product having an iron amount greater than a silicon amount that is reroll annealed at 850° F. (454° C.).

2. The method of claim 1, wherein the iron and silicon each range between 0.55–0.75 wt %.

3. The method of claim 2, wherein the silicon amount is at least 0.05 wt % greater than the iron amount.

4. The method of claim 2, wherein the Cu is 0.05 wt % max, Mn is 0.02 wt % max, Mg is 0.02 wt % max, Cr is 0.02 wt. % max, Zn is 0.03 wt % max, and Ti is 0.03 wt % max.

5. The method of claim 2, wherein iron ranges between 0.55 and 0.60 wt % and the silicon ranges between 0.60 and 0.65 wt %.

6. The method of claim 2, wherein the reroll anneal temperature ranges between 750° F. and 800° F. (399° C. and 427° C.).

7. In a method of making an aluminum alloy foil product comprising the steps of casting an alloy consisting essentially of, in weight percent, 0.30–1.1 Si, 0.40–1.0 Fe, max 0.10 Cu, max 0.10 Mn, max 0.05 Mg, max 0.05 Cr, max 0.10 Zn, max 0.08 Ti, with the balance aluminum and unavoidable impurities into a cast slab of specified thickness, cold rolling the cast slab to an intermediate gauge strip, reroll annealing the intermediate gauge strip for a period of time, final cold rolling the intermediate gauge strip to a foil and final recrystallizing annealing the foil to form a foil product, the improvement comprising controlling the amounts of silicon and iron in the alloy so that the silicon amount is equal to or greater than the iron amount and reroll annealing the intermediate gauge sheet at a maximum temperature of 825° F. (441° C.) for said period of time, wherein the foil product having the silicon amount greater than or equal to the iron amount has a higher elongation when reroll annealed at 825° F. (441° C.) than an AA8111 foil product having an iron amount greater than a silicon amount that is reroll annealed at 850° F. (454° C.).

8. In a method of making an aluminum alloy foil product comprising the steps of casting an alloy consisting essentially of, in weight percent, 0.30–1.1 Si, 0.40–1.0 Fe, max 0.10 Cu, max 0.10 Mn, max 0.05 Mg, max 0.05 Cr, max 0.10 Zn, max 0.08 Ti, with the balance aluminum and unavoidable impurities into a cast slab of specified thickness, cold rolling the cast slab to an intermediate gauge strip, reroll annealing the intermediate gauge strip for a period of time, final cold rolling the intermediate gauge strip to a foil and final recrystallizing annealing the foil to form a foil product, the improvement comprising controlling the amounts of silicon and iron in the alloy so that the silicon amount is equal to or greater than the iron amount and reroll annealing the intermediate gauge sheet at a maximum temperature of 825° F. (441° C.) for said period of time, wherein the foil product having a silicon amount greater than or equal to the iron amount has a constituent size generally larger than the constituent size of an AA8111 foil product having an iron amount greater than a silicon amount, the larger constituent size contributing to a finer grain size in the foil product than in the AA8111 foil product.

9. The method of claim 1, wherein the alloy containing the controlled amounts of silicon and iron is cast to a thickness no greater than about 0.240 inches (6 mm).

10. The method of claim 1, wherein the cast slab is cold rolled to an intermediate gauge ranging between about 0.010 and 0.045 inches (0.25 mm and 1.14 mm) and the foil product has a thickness ranging between between about 0.0006 inches (15 μm) and about 0.0007 inches (18 μm).

11. A method of making an aluminum alloy foil comprising the steps of:

a) providing an aluminum alloy melt consisting essentially of, in weight percent, about 0.55 to 0.75 Fe, about 0.55 to 0.75 Si, a maximum of 0.05 Cu, a maximum of 0.03 Mn, a maximum of 0.02 Mg, a maximum of 0.02 Cr, a maximum of 0.03 Zn, a maximum of 0.03 Ti, with the balance aluminum and unavoidable impurities, wherein the silicon is equal to or greater than the iron;

b) twin roll casting said aluminum alloy melt into a cast slab of a thickness less than or equal to about 0.240 inches (6 mm);

c) cold rolling said cast slab into an intermediate thickness ranging between 0.010 inches to 0.045 inches (0.25 and 1.14 mm);

d) reroll annealing said intermediate gauge strip at a temperature between about 750° (399° C.) and 800° F. (427° C.) for a period of time;

e) final cold rolling said annealed intermediate gauge strip to a foil having a thickness ranging between 0.0005 and 0.0020 inches; and f) final annealing said foil to fully recrystallize said foil.

12. The method of claim 11, wherein the amount of silicon is about 0.05 wt % greater than the amount of iron.

13. A method of making an aluminum alloy foil comprising the steps of:

a) providing an aluminum alloy melt consisting essentially of, in weight percent, silicon between about 0.65 and 0.70, iron between about 0.60 and 0.65, a maximum of 0.05 Cu, a maximum of 0.03 Mn, a maximum of 0.02 Mg, a maximum of 0.02 Cr, a maximum of 0.03 Zn, a maximum of 0.03 Ti, with the balance aluminum and unavoidable impurities, wherein the silicon is equal to or greater than the iron;

b) twin roll casting said aluminum alloy melt into a cast slab of a thickness less than or equal to about 0.240 inches (6 mm);

c) cold rolling said cast slab into an intermediate thickness ranging between 0.010 inches to 0.045 inches (0.25 and 1.14 mm);

d) reroll annealing said intermediate gauge strip at a temperature equal to or less than 825° F. (441° C.) for a period of time;

e) final cold rolling said annealed intermediate gauge strip to a foil having a thickness ranging between 0.0005 and 0.0020 inches; and f) final annealing said foil to fully recrystallize said foil.

14. In a method of making an aluminum alloy foil product comprising the steps of casting an alloy consisting essentially of, in weight percent, 0.55–0.75 Si, 0.55–0.75 Fe, max 0.10 Cu, max 0.10 Mn, max 0.05 Mg, max 0.05 Cr, max 0.10 Zn, max 0.08 Ti, with the balance aluminum and unavoidable impurities into a cast slab of specified thickness, cold rolling the cast slab to an intermediate gauge strip, reroll annealing the intermediate gauge strip for a period of time, final cold rolling the intermediate gauge strip to a foil and final recrystallizing annealing the foil to form a foil product, the improvement comprising controlling the amounts of silicon and iron in the alloy so that the silicon amount is equal to or greater than the iron amount and reroll annealing the intermediate gauge sheet at a temperature of between 750° F. (399° C.) and 800° F. (427° C.) for said period of time.

* * * * *